US011393372B2

(12) United States Patent
Hochheim et al.

(10) Patent No.: US 11,393,372 B2
(45) Date of Patent: Jul. 19, 2022

(54) VIDEO LIGHTING APPARATUS WITH FULL SPECTRUM WHITE COLOR

(71) Applicant: KINO FLO, INC., Burbank, CA (US)

(72) Inventors: Frieder Hochheim, Burbank, CA (US); Jim Bogdanowicz, Burbank, CA (US); Mark Primrose, Burbank, CA (US)

(73) Assignee: CHAUVET & SONS, LLC, Sunrise, FL (US)

( * ) Notice: Subject to any disclaimer, the term of this patent is extended or adjusted under 35 U.S.C. 154(b) by 0 days.

(21) Appl. No.: 17/082,454

(22) Filed: Oct. 28, 2020

(65) Prior Publication Data

US 2021/0125535 A1 Apr. 29, 2021

Related U.S. Application Data

(60) Provisional application No. 62/927,019, filed on Oct. 28, 2019.

(51) Int. Cl.
*G09G 3/14* (2006.01)

(52) U.S. Cl.
CPC ..... *G09G 3/14* (2013.01); *G09G 2300/026* (2013.01); *G09G 2300/0452* (2013.01); *G09G 2340/06* (2013.01)

(58) Field of Classification Search
CPC ..... G09G 3/14; G09G 2300/026; G09G 2300/0452; G09G 2340/06; G03B 15/02; G03B 15/06; G03B 15/07; F21V 23/003
See application file for complete search history.

(56) References Cited

U.S. PATENT DOCUMENTS

| | | | | |
|---|---|---|---|---|
| 8,169,389 | B2 * | 5/2012 | Cok | H04N 9/67 345/83 |
| 10,718,474 | B1 * | 7/2020 | Von Fange | F21K 9/50 |
| 2013/0214704 | A1 * | 8/2013 | Gerlach | H05B 45/24 315/312 |
| 2017/0146203 | A1 * | 5/2017 | Belaidi | F21V 21/005 |
| 2017/0354013 | A1 * | 12/2017 | DeMayo | H05B 47/125 |
| 2018/0112862 | A1 * | 4/2018 | Gammons | H05B 47/19 |

* cited by examiner

*Primary Examiner* — Antonio A Caschera
(74) *Attorney, Agent, or Firm* — Womble Bond Dickinson (US) LLP

(57) ABSTRACT

A system for creating a broad spectrum lighting apparatus for illuminating a subject. The system includes a lighting panel formed by an array of colored light emitting diodes (LEDs) representing pixels corresponding to red pixels, green pixels, blue pixels, and pixels corresponding to at least color other than red, green or blue. A control interface converts a video signal consisting of red, green, blue (RGB) data into a full spectrum light display including all of the LEDS to create a higher quality white than would have been possible with only RGB LEDs.

6 Claims, 5 Drawing Sheets

VIDEO LIGHTING APPARATUS WITH FULL SPECTRUM WHITE COLOR

BACKGROUND OF THE INVENTION

Motion picture visual effects have relied heavily on blue screen and green screen compositing techniques. The use of high resolution video walls or displays to replace green screens is becoming more common. The video image relies on the principle of Red, Green and Blue LEDs (RGB) to render the image. Increasingly cinematographers are trying to use the RGB light emanating from the display screen as an illuminant for the foreground images they are photographing. The RGB spectrum is deficient in broad spectrum white light which is critical for properly rendered skin tones as well as other subject colors.

Conventional lighting apparatus are controlled from lighting dimmer boards that send a digital multiplex (DMX) signal for a light to behave in a predetermined manner. Lighting apparatus can consist of several independently controlled elements or pixels. A lighting board can be tailored to synchronize with a video signal but can only generate as many pixel controls as the lighting instrument is designed with. They are large in area and are not designed to reproduce a video image.

This invention sets out to create an Illumination apparatus operating on the principles of an RGB video display such as shown in FIG. 1. It consists of a plurality of individual pixels per panel, controlled through a video signal as in a video display wall.

SUMMARY OF THE INVENTION

This invention sets out to remedy the color imbalance which exists in the prior art from the blending of RGB LEDs as well as their shadow enhancement capabilities. This invention utilizes a light source that operates from a video signal and uses the RGB data to illuminate foreground subject or subjects appearing in front of the video wall. This illumination apparatus operates on a video signal through pixels formed using RGB LEDs plus additional LEDs which are not RGB LEDs as shown in FIG. 2. The additional LEDs take the white light information of the video RGB which is processed into a fuller and broader white light spectrum. Examples of a display which could be used as a lighting panel which include pixels with additional LEDs include commercially available megapixel video walls. The video display and illumination apparatus can operate from the same video signal in synchronization. This ensures color changing or shadow changing effects on foreground subjects synchronized to the background display in real time. Broad light spectrum is necessary for better color rendering of real world colors in skin tones, objects and the environment.

DETAILED DESCRIPTION OF THE INVENTION

The invented solution is to use a greater than three LED system (for example; Red, Green, Blue, Cool White and Warm White) for a video wall used as a light source for subjects captured on camera. This allows for higher quality white light compared to white light created by narrow FWHM (full width at half maximum) RGB LEDs. The pixelated nature of the video wall allows the light emanating from the video wall to be used to create specific effects and light movement that cannot be done with existing lighting systems.

Figure 1:
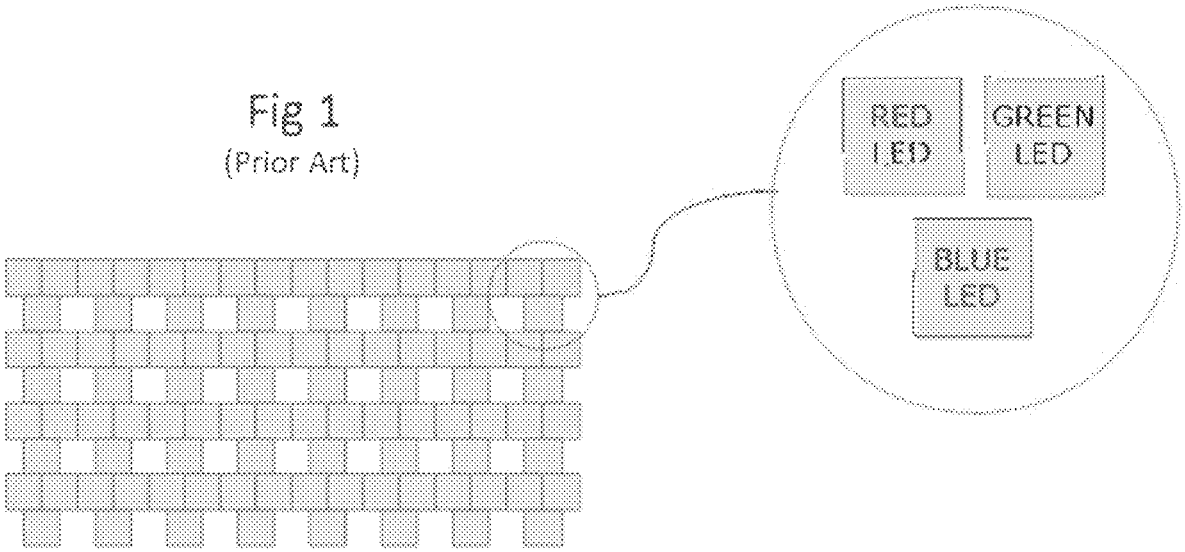
Fig 1 (Prior Art)
FIG. 1 shows a typical prior art lighting panel with only RGB LED pixels with one pixel magnified to show one pixel with 3 LEDs.
Figure 2:
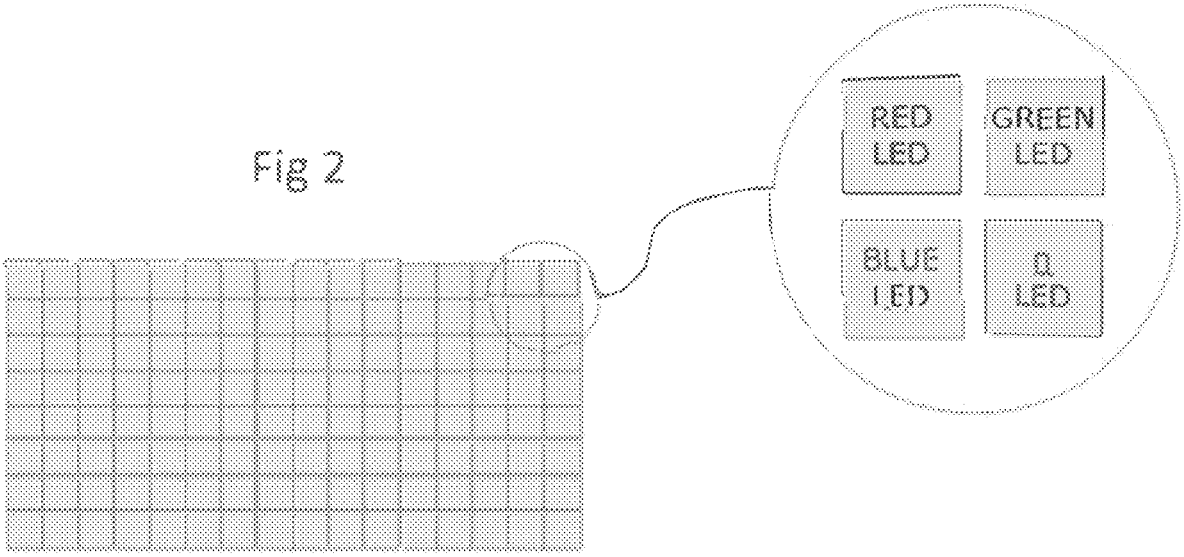
FIG. 2 shows the invented lighting panel with RGB LED pixels and an additional LED with one pixel magnified to show one pixel with 4 LEDs.
Figure 3:
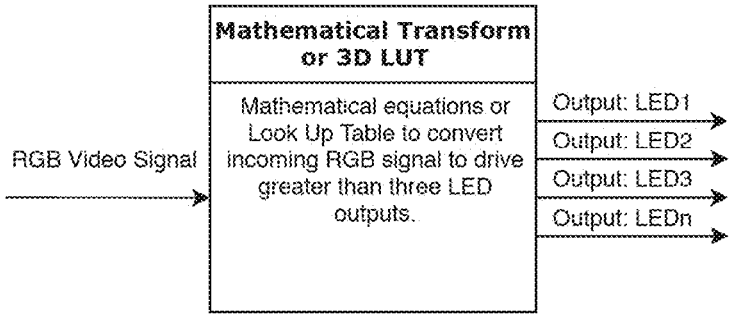
FIG. 3 is a block diagram showing the operation of a 3DLut.

To do this, the RGB video signal needs to be mapped to the greater than three LED system as shown in FIG. 3. A three input, greater than three output 3DLut (3D look up table) is needed to drive the LEDs appropriately. The output of the 3DLut is determined by the desired criteria. This could be to have the highest color quality and maintain input luminance within the frame, create maximum luminance based on the capability of LEDs or any other criteria.

The 3DLut is in the video pipeline right before the LED driver electronics. The 3DLut could be applied to the gamma encoded signal or a 1DLut could be used to modify the video signal and the 3DLut could be applied to the modified video. As to the specifics of a 3DLut (or 1DLut), such look up tables are well known mechanisms to map one color space to another to, for example, calculate preview colors for a monitor or digital projector of how an image will be reproduced on another display device, typically the final digitally projected image or a release print of a movie. More specifically, persons skilled in the art would readily know how to create a 3DLut which maps a set of three RGB values to another set of three RGB values, typically to adjust the output which is displayed on a particular display so that the colors appear closer to the actual RGB values than would otherwise be the case. According to the invention, instead of a 3 to 3 mapping, a 3 to 3+n mapping is used where n is the additional number of LEDs used to produce a full white spectrum with a higher quality white than would otherwise be the case. As one example, assume 3×8 bit color space with R=255, G=255 and B=255 which should be displayed as pure white. But due to the characteristics of the RGB LEDs of the display, the white as displayed is not of the highest quality. A person skilled in the art knowing the characteristics of the RGB, and non RGB LEDs of the display would know that the display produces a high quality pure white by transforming the 255 255 255 RGB values to 255 254 250 255 255 where the first three values are the values provided to the RGB pixels respectively and the last two values are respectively mapped to the two additional LEDs. A 3DLut is created in this manner. Of course, the specific mappings would depend on the characteristics of the LEDs in use and the desired lighting output. In an embodiment, instead of or in addition to a 3DLut, controls could be used to adjust the output values until the desired lighting effect is obtained. Separate control of the additional LEDs allows for the color quality to be adjusted to desired settings. The specifics of such a control mechanism which simply adjusts a value provided to each of the LEDs making up a pixel are well known to video lighting practitioners and is usually implemented via software in commercially available video wall processors. The 3DLut and control mechanism can be embedded in the panel or as a separate element which connects to the panel such as a commercially available receiver card.

Another objective of this invention is to be able to simulate moving image patterns from a scene in synchronization with the video image from the source. For example, walking or driving under a tree canopy results in patterns of sunlight penetrating the leaves. Simply using a synchronized display wall above an actor would project the green of the leaves as well as any sunlight in a blended fashion that would appear as a soft light wash over the foreground scene. The scene in its blended form would appear greener than daylight. There would not be any visible distinct pattern of sunlight through leaves. Direct beams of light need to be generated at a narrow beam angle. To lessen the influence of other colors, the light should be able to independently control and desaturate the RGB pixels while independently controlling the additional LEDs to simulate the sunlight.

Figure 4:
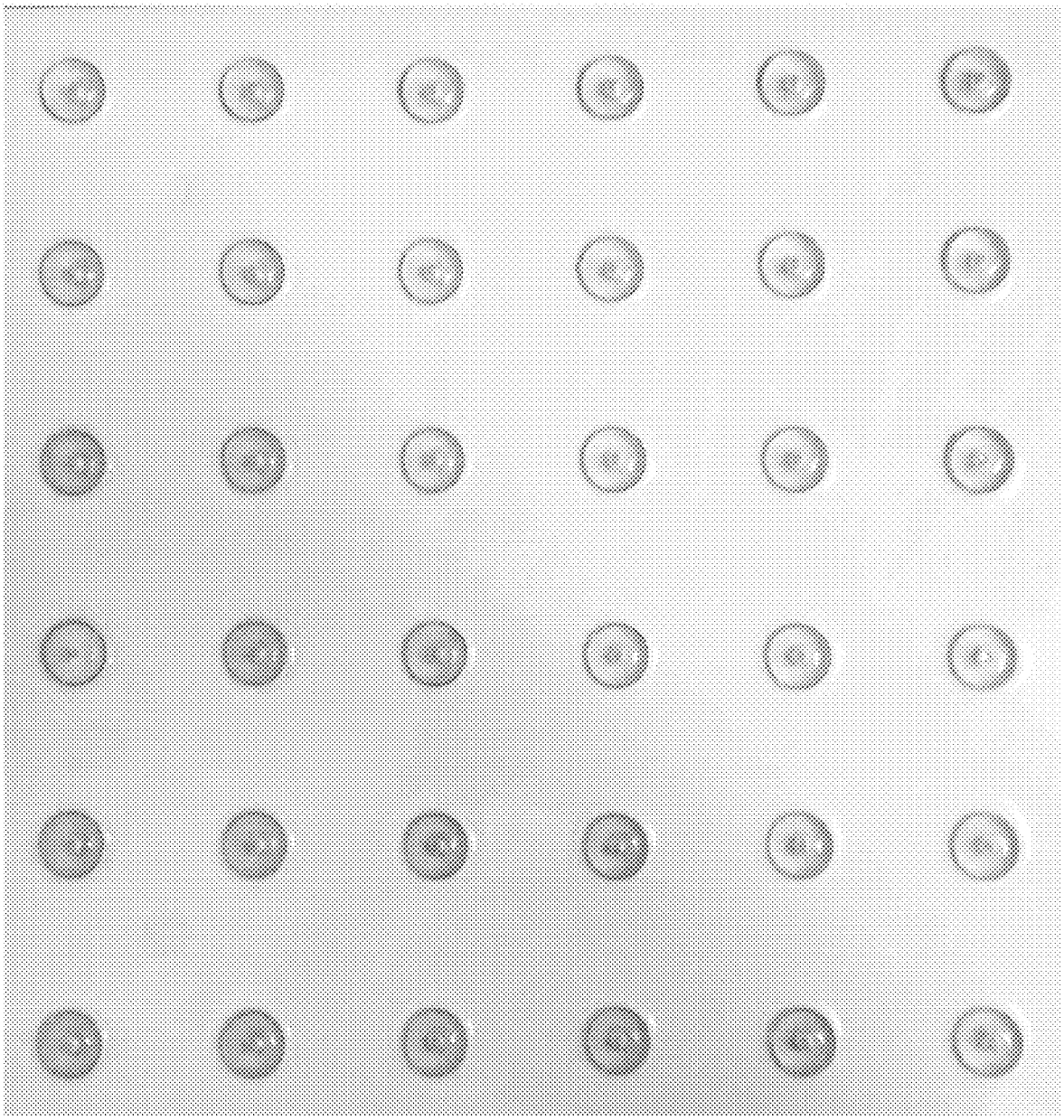
FIG. 4 show LEDs forming a lighting panel fitted with lenses.
Figure 5:
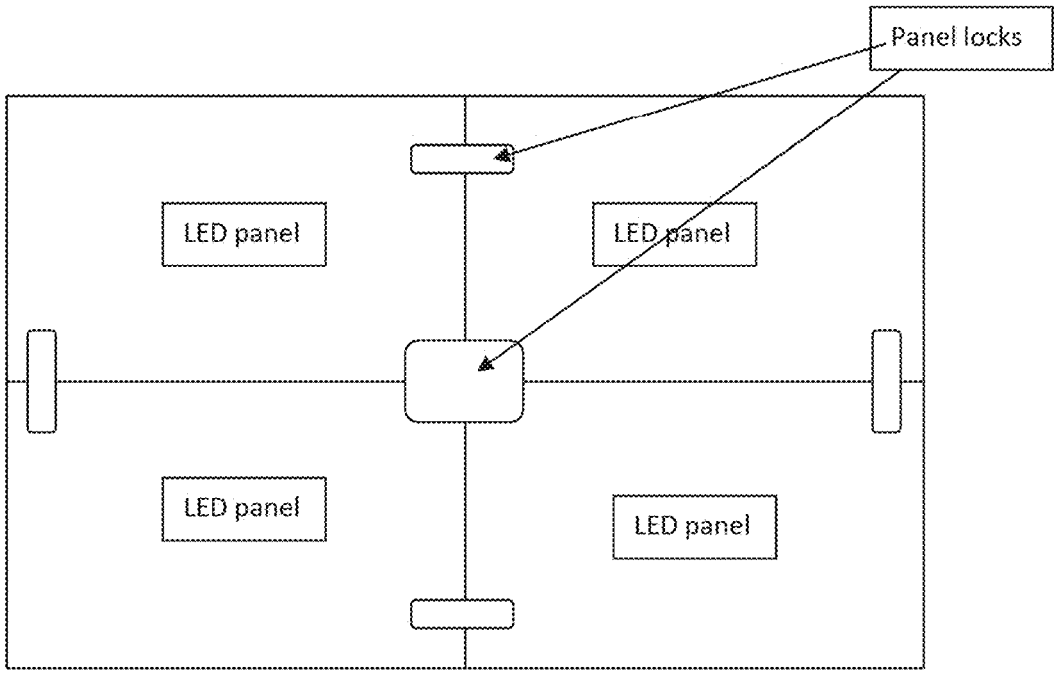
FIG. 5 shows four lighting panels mechanically interlocked each other.

The invention is directed to an LED display panel using more than three LEDs for each pixel. The LEDs would consist of Red, Green, Blue and at least one additional source LED. Each LED pixel in one embodiment is fitted with narrow beam lenses as shown in FIG. 4. Another iteration of the panel would have unlensed LEDs. Lens LEDs allow a narrow beam angle for directional throw. The lighting panel is able to operate as a stand-alone panel or interlinked with additional panels to form a larger panel, or in greater numbers as a wall of panels as shown in FIG. 5.

The panel or panels operate at sufficient frequency to allow for the video to be genlocked or synchronized to a camera at various frame rates per second. Traditionally, cameras can be set to frame rates of, but not limited to 24 fps, 48 fps, 96 fps and 120 fps. The panel allows for separate control of the RGB portion of the video data stream from the one or more additional LEDs. The separate control over the RGB pixels would allow the colors to be desaturated while maintaining the visual pattern of the streaming video image.

Figure 6:
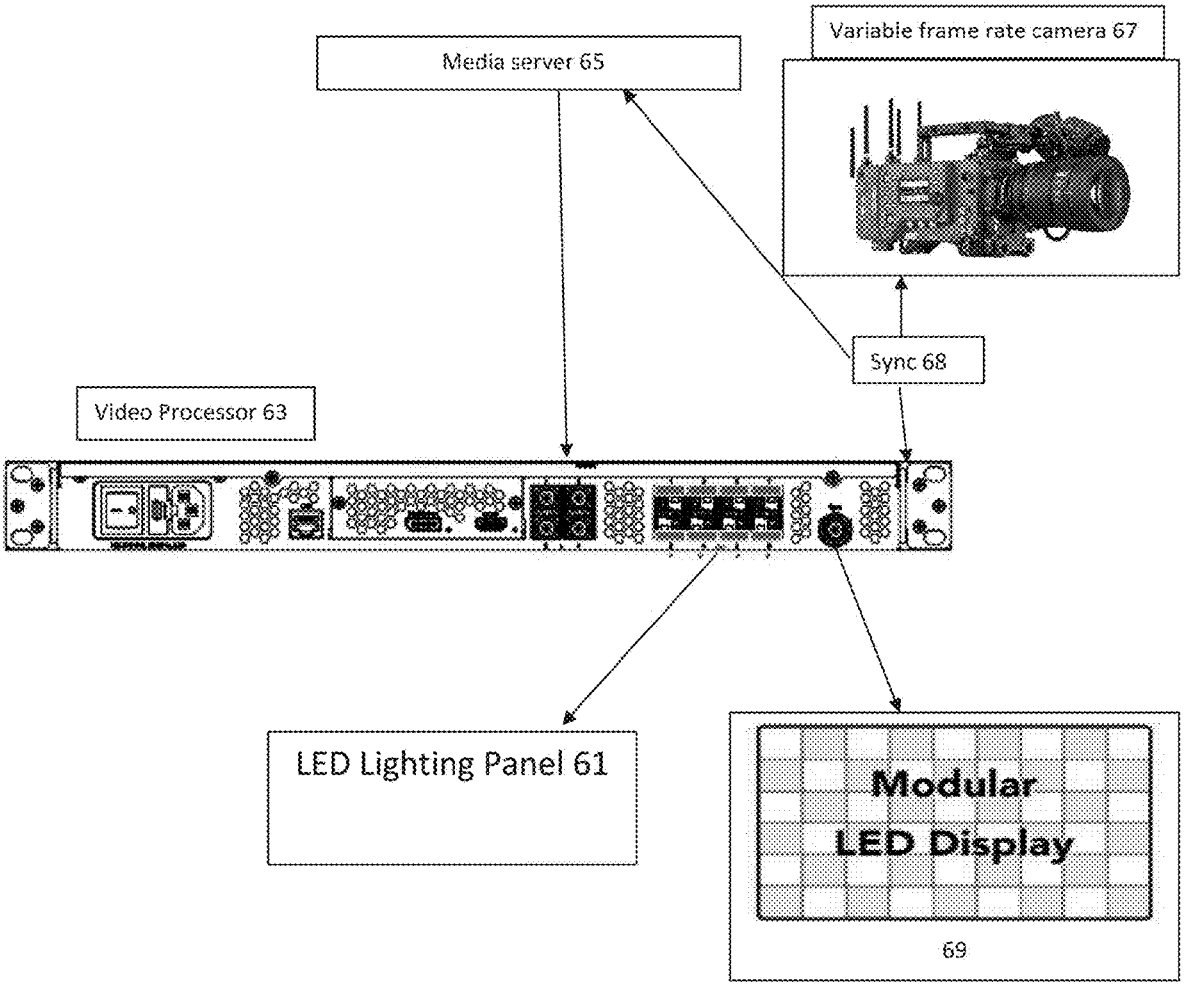
FIG. 6 shows a variable frame rate camera and the lighting panel operating at a frequency which allows synchronization with frame rates of the variable camera and lighting panel.

FIG. 6 shows an example of a use of the invented LED lighting panel 61 used to illuminate a foreground subject (not shown). Video processor 63 such as Megapixel VR®'s HELIOS LED Processing Platform receives a video feed in the form of video signals from media server 65 as is well known in the art. Such video signals would be, for example, serial digital data. A variable frame rate camera 67 such as a commercially available high end cinema camera typically used for motion pictures provides video signals representing the foreground subject. Sync device 68 is a commercially available master sync device which generates sync signals to processor 63, server 65 and camera 67 to ensure that each video frame provided by server 65 and camera 67 are synchronized when the video signals generated by processor 63 are provided to LED lighting panel 61 and modular LED display 69 which displays the foreground subject and background provided by media server 65.

The foregoing descriptions of specific embodiments and devices is used to illustrate the invention and how it may be implemented, but such embodiments and devices are not intended to limit the scope of the invention as defined by the following claims.

We claim:

1. A system for creating a broad-spectrum lighting apparatus comprising:

a lighting panel including an array of first light emitting diodes (LEDs) representing pixels corresponding to red pixels, green pixels and blue pixels and second LEDs representing pixels corresponding to at least one color other than red, green and blue;

a video processor control interface that converts a video signal with a predetermined colorimetry consisting of three data channels into individual control of said first LEDs and said second LEDs to create a matching color point that is for colors less than 100% saturation, spectrally broader than a color point created using said only first LEDs for illuminating, by said lighting panel, a subject to be captured by a digital imaging device, wherein said converting uses said second LEDs to maintain the predetermined colorimetry of the video signal, and said matching color point light minimizes a metameric effect of the illuminated subject compared to what would have been possible with illuminating said subject using only said first LEDs.

2. The system defined by claim 1 in which a video feed is synchronized with a motion picture camera and said lighting panel.

3. The system defined by claim 1 wherein the first and second LEDs are fitted with lenses.

4. The system defined by claim 1 wherein said lighting panel is mechanically interlocked with at least one additional lighting panel to create larger surface lighting apparatus.

5. The system defined by claim 1 wherein a variable frame rate camera and said lighting panel operate at a frequency which allows synchronization with frame rates of said variable frame rate camera and lighting panel.

6. The system defined by claim 1 wherein the RGB LEDs are controlled independently of the second LEDs.

* * * * *